US010765159B1

(12) United States Patent
Holcomb

(10) Patent No.: US 10,765,159 B1
(45) Date of Patent: Sep. 8, 2020

(54) HEAD MASK WITH CUSHIONED COLLAR

(71) Applicant: Dan-Dee International, Ltd., Jersey City, NJ (US)

(72) Inventor: Gary Holcomb, Largo, FL (US)

(73) Assignee: Dan-Dee International, Ltd., Jersey City, NJ (US)

( * ) Notice: Subject to any disclaimer, the term of this patent is extended or adjusted under 35 U.S.C. 154(b) by 570 days.

(21) Appl. No.: 15/478,630

(22) Filed: Apr. 4, 2017

(51) Int. Cl.
*A42B 1/00* (2006.01)
*A41G 7/00* (2006.01)

(52) U.S. Cl.
CPC ..... *A42B 1/004* (2013.01); *A41G 7/00* (2013.01)

(58) Field of Classification Search
CPC ..... A41G 7/00; A42B 1/004
USPC ..... 2/206
See application file for complete search history.

(56) References Cited

U.S. PATENT DOCUMENTS 4,175,411 A * 11/1979 Allen ..... A41G 7/00 2/173
4,451,933 A * 6/1984 Seng ..... A41G 7/00 2/173
5,035,004 A * 7/1991 Koester ..... A42B 1/004 2/10
5,546,604 A * 8/1996 Geller ..... A42B 1/045 2/173
6,651,256 B1 * 11/2003 Swift ..... A42B 1/004 2/15
2010/0299838 A1 * 12/2010 Lanci ..... B60N 2/882 5/645

* cited by examiner

*Primary Examiner* — Khoa D Huynh
*Assistant Examiner* — Brieanna Szafran
(74) *Attorney, Agent, or Firm* — Amster, Rothstein & Ebenstein LLP

(57) ABSTRACT

A head mask, configured to cover the head of a wearer, includes a shell that includes bendable foam and a soft fabric on the exterior of the shell. The head mask further includes a cushioned collar at the bottom of the head mask to prevent discomfort when the head mask impacts the wearer. The collar may be cushioned, for example, by making the collar thicker than the combined thickness of the shell and decorative fabric, such as by folding the bendable foam of the shell and the soft fabric inwardly and attaching the folded bendable foam and soft fabric materials to the shell, or by increasing the thickness of the bendable foam or fabric layer used in the collar. The head mask further includes one or more openings for the eyes and for breathability, where the openings may be covered with a one-way mesh.

20 Claims, 6 Drawing Sheets

HEAD MASK WITH CUSHIONED COLLAR

FIELD OF THE INVENTION

The present invention generally relates to a head mask.

BACKGROUND OF THE INVENTION

A head mask, as used herein, is a head covering that is worn over a person's head. Head masks may be used, for example, to conceal a wearer's identity or to allow a wearer to dress-up for an event, such as for a sports event, a masquerade party, a carnival, or Halloween. A typical head mask has an opening at the bottom through which a wearer may insert his or her head into an interior cavity of the head mask and is shaped and decorated on its exterior such that it has a desired appearance (e.g, an animal head or a famous character). Sometimes, a head mask is used by itself. At other times, the head mask may be used as part of a partial or full body costume.

Often, a head mask extends from the top of the head downward to the vicinity of the wearer's neck and shoulders. In this case, the lower edge of the bottom opening comes into contact repeatedly with the wearer in the vicinity of the shoulders or neck as the wearer's head moves, thereby potentially causing discomfort to the wearer, such as possible skin irritation and other aches and pains. The discomfort may increase as the head mask is worn for an extended duration, possibly for several hours at a time. These effects may be pronounced where the head mask opening does not provide much clearance for a wearer's neck.

SUMMARY OF THE INVENTION

The present invention generally relates to a head mask that is more comfortable for a wearer, especially when worn over an extended period of time.

In an exemplary embodiment of the present invention, a head mask includes a shell that has one or more openings configured to enable a wearer to see outside of the head mask when the head mask is worn by the wearer, an interior cavity within the shell, and an aperture through which a wearer's head is insertable into the interior cavity. The head mask further includes a collar that is formed at the bottom of the head mask, wherein the shell has a first thickness, and wherein the collar has a second thickness that is larger than the first thickness. The head mask may further include a fabric layer covering at least a portion of an exterior of the head mask, including the collar. In one embodiment, the head mask may also have one or more additional layers between the shell and the fabric layer.

In one embodiment, the shell of the head mask includes a bendable foam, and the collar includes multiple overlapped layers of bendable foam formed by folding of the bendable foam at the bottom of the head mask inwardly at least once, and attaching the inwardly folded layer to the shell to be held in place. In this embodiment, the fabric layer on the exterior of the head mask may also be folded inwardly over the inwardly folded bendable foam. Where the collar includes the same bendable foam as the shell, the bendable foam may be formed integrally with the bendable foam of the shell. In an alternative embodiment, the bendable foam for the collar may include a second piece of bendable foam that is attached to the rest of the shell. In these embodiments, the increased thickness of the collar portion of the head mask may be attributable to the additional thickness added by the at least one additional layer of bendable foam provides the wearer with a desirable cushioning. Moreover, the additional fabric layer from the folding of the fabric layer over the bendable foam may also provide additional cushioning.

In another exemplary embodiment, the collar includes a second bendable foam, which may be the same as or different from the first bendable foam, and the second bendable foam that has the second thickness that is larger than the first thickness. Thus, it may not be necessary in this embodiment to fold the bendable foam inwardly as the second bendable foam already has the second thickness. The second bendable foam may be formed integrally with the shell or includes a second piece of bendable foam that is attached to the bendable foam of the shell.

In yet another exemplary embodiment where a fabric layer covers the collar, the second thickness of the collar is attributable, at least in part, to the fabric layer that has an increased thickness around the collar.

In embodiments, the thickness and height of the collar may each be in the range of 1 to 2 inches.

BRIEF DESCRIPTION OF THE DRAWINGS

Exemplary embodiments of the present invention will be described with reference to the accompanying figures, wherein.

DETAILED DESCRIPTION

Figure 1:
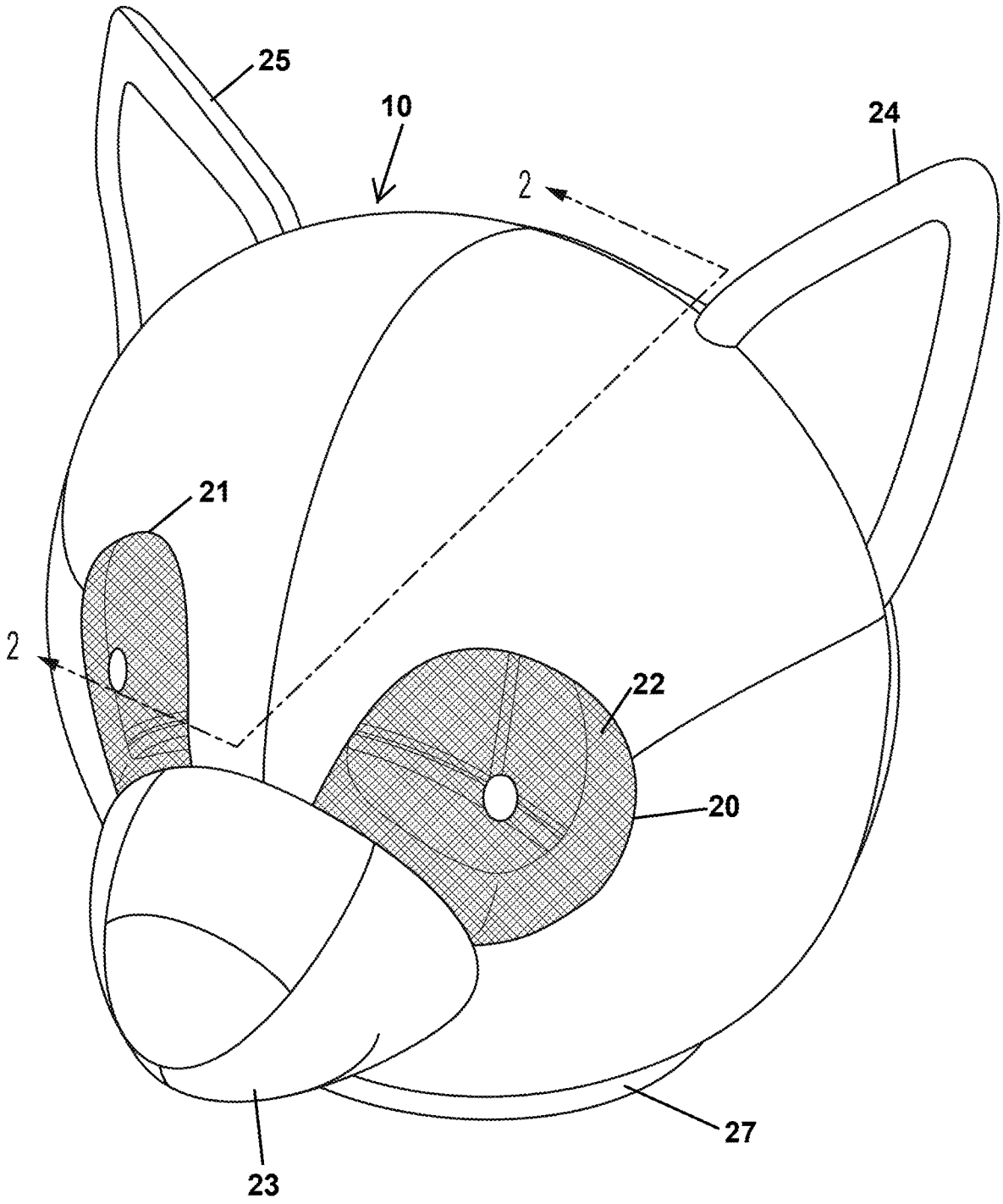
FIG. 1 is a perspective view of a head mask according to an exemplary embodiment of the present invention.

Referring now to the drawings, and in particular to FIG. 1 thereof, a head mask 10 in accordance with a first embodiment of the present invention is illustrated. While the exterior of head mask 10 may be shaped and decorated in many different ways, head mask 10 is shown in the illustrated embodiment as an animal head with the exterior surface shaped and decorated as a an animal head. However, it should be understood that the appearance of head mask 10 in FIG. 1 is only illustrative. Thus, a head mask 10 in accordance with the present invention may be shaped and/or decorated in any manner on its exterior.

Referring back to FIG. 1, head mask 10 is depicted as including left and right eye openings 20, 21, a nose 23 that protrudes outward from underneath left and right eye openings 20, 21, and left and right ears 24, 25 that protrude from the top of head mask 20. Left and right eye openings 20, 21 are covered in a one-way mesh material 22 that enable a wearer to see out from head mask 10 but preferably do not permit other individuals to see the wearer. Mesh material 22 also enables air to flow inside head mask 10 for breathability. An example of such a one-way mesh material 22 includes a black mesh fabric eye cover available from www.etsy.com. A collar 27 is provided at the bottom of head mask 10. As illustrated, collar 27 extends around the bottom of head mask 10 and surrounds an aperture 28 (opening) (shown in FIG. 2), or at least a part thereof, through which a wearer inserts his or her head to don head mask 10. Aperture 28 may have one of various shapes, such as a circular shape having a diameter in a range of between 7 to 10.5 inches or an oval diameter having a small and large diameter in the same range. Alternatively, aperture 28 may be of any desirable size and shape provided that the head of the wearer can be inserted therethrough into the head mask. Eye openings 20, 21 may be, as a non-limiting example, in the range of 3 to 5 inches in diameter.

Figure 2:
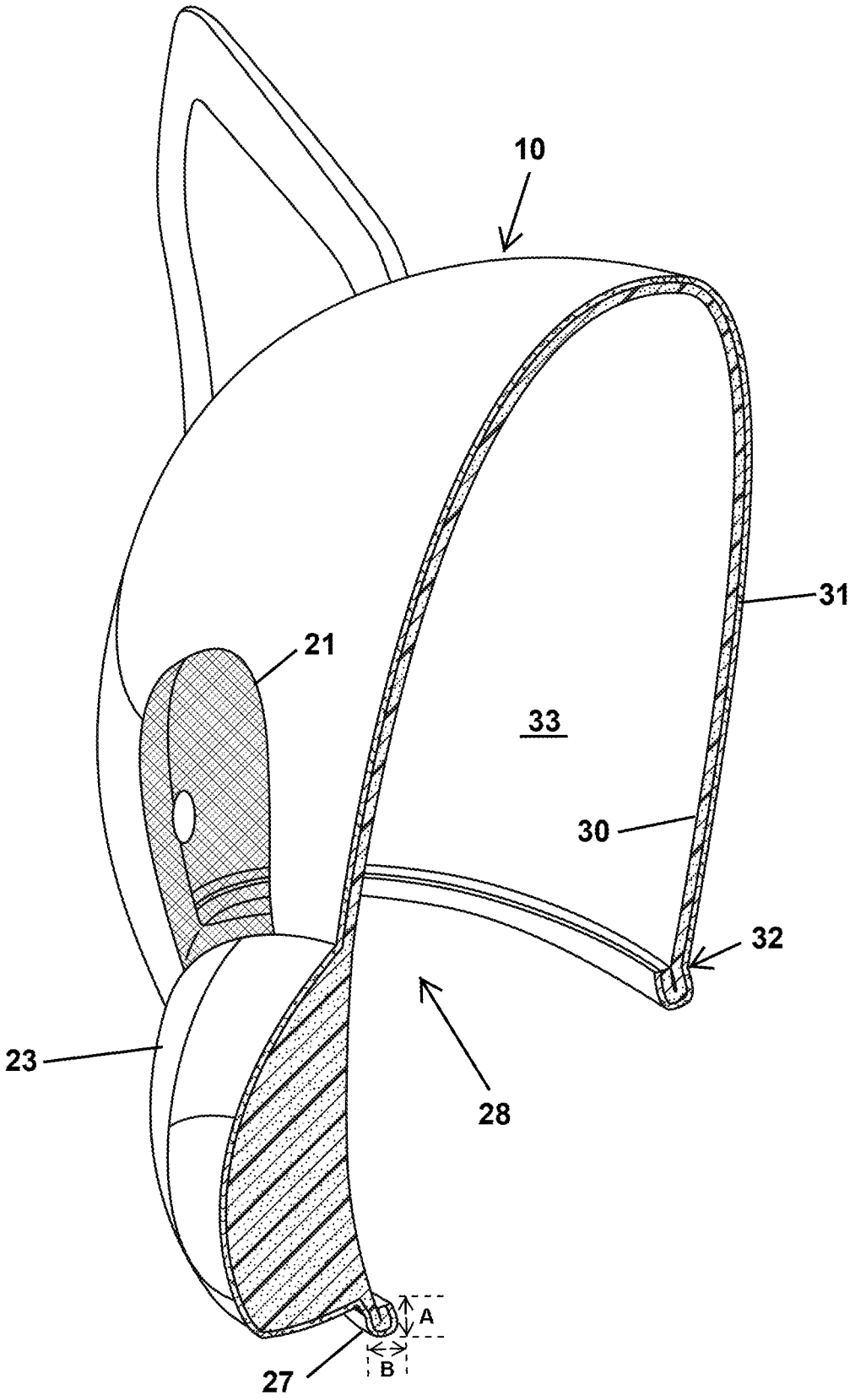
FIG. 2 is a cutaway view of the head mask taken vertically along line 2-2 of FIG. 1.

FIG. 2 is a cutaway view of head mask 10 taken vertically along line 2-2 of FIG. 1 and illustrates an interior of head mask 10 in an exemplary embodiment. As shown in FIG. 2, a shell 30 is formed from one or more pieces of a bendable foam that provides a soft padding or from some other soft, resilient material. (Where more than one piece of the bendable foam is used, the pieces may be connected together adjacent to one another, such as with stitching). The bendable foam shell 30 may be formed from plush material bonded or laminated to foam sheets. In addition to the bendable foam, shell 30 may also include a soft liner (not shown) attached to the bendable foam on an interior surface 30 facing the wearer. In embodiments, shell 30 may be in the range of approximately 1/16 to 1/4 inches thick. Also, in embodiments, shell 30 may extend throughout the interior of head mask 10 or in portions thereof but not in the area of eye openings 20, 21. The space within head mask 10 that includes shell 30 may be referred to as the interior cavity.

Figure 3:
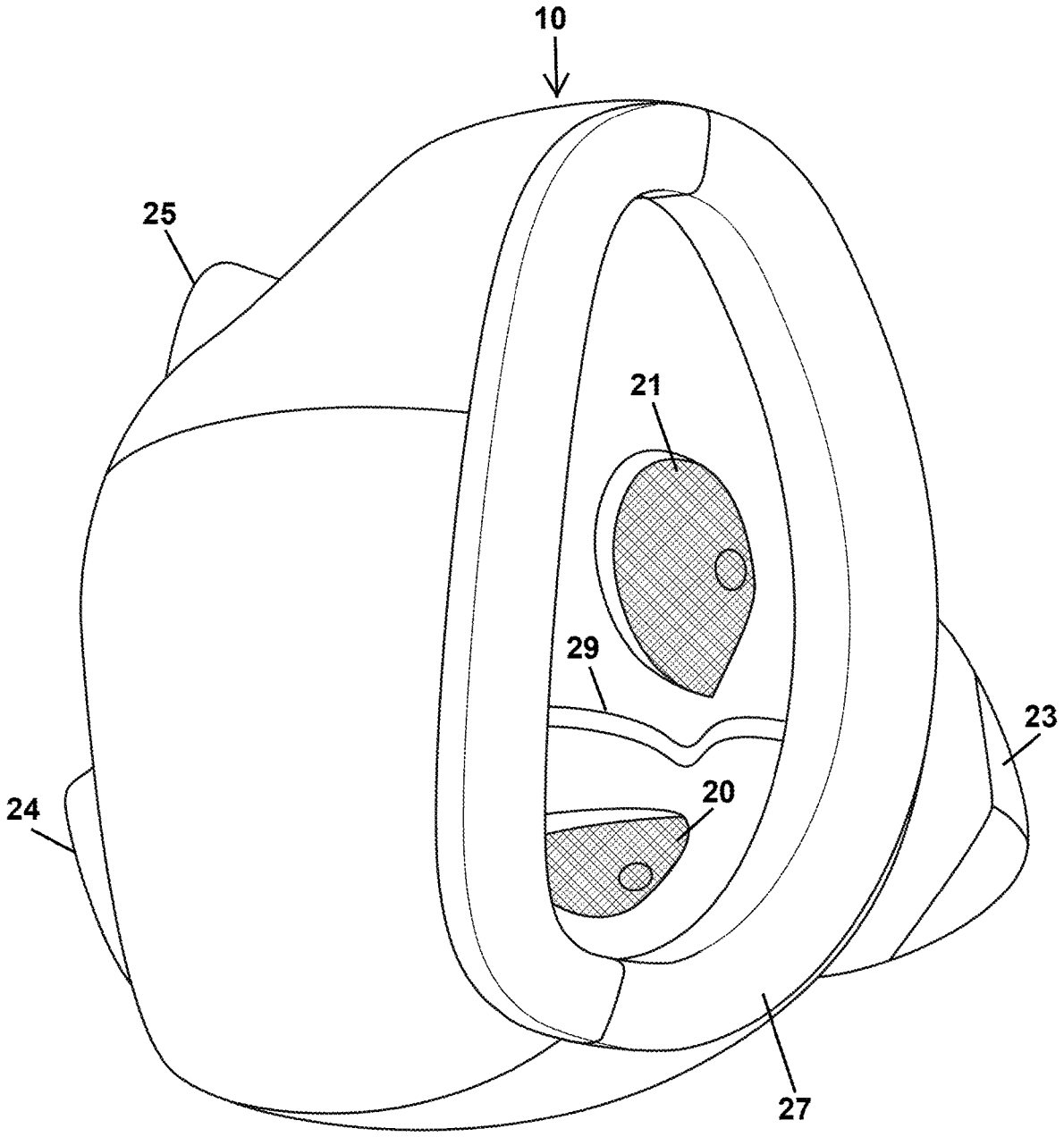
FIG. 3 is a perspective view of the head mask of FIG. 1 as viewed from the bottom of the head mask.

Referring to FIG. 3, the interior shape of shell 30 may be reinforced with additional stitching along interfaces of the pieces of soft padding so as to form seams or ribs 29 inside head mask 10. Apart from eye openings 20, 21, the exterior of head mask 10 is generally covered with one or more decorative materials, that may include a soft fabric layer 31, which may also be plush and/or furry, and one or more other layers between shell 30 and fabric layer 31. An additional layer of soft material, such as a hypoallergenic lining (not shown), may be included as an interior liner to cover the inside of shell 30.

Referring to FIGS. 2 and 3, in embodiments of the present invention, collar 27 is cushioned. Cushioning may be provided, for example, by folding a bottom piece of shell 30 and fabric layer 31 inwardly at least once such that a bottom portion of shell 30 is at least folded over onto itself to provide a double layer of bendable foam and lining such that at least a portion of each of the layers of bendable foam overlap one another. The two layers of shell and lining materials may be secured together in the folded position, such as by attaching the inwardly folded portion of shell 30 to the shell itself along line 32 or to a larger area of shell 30, to form collar 27. Any secure method of attachment may be used, such as with a more permanent attachment such as stitching or hot melt gluing, or with a releasable attachment such as with a zipper or buttons. The portion of shell 30 that is folded inwardly may be integrally formed with a portion of shell 30 located above collar 27 or may be formed from a separate portion of material that is attached to the bottom of shell 30. Similarly, the portion of fabric layer 31 that wraps around the collar 27 may be formed integrally with a portion of fabric layer 31 located above collar 27 or may be constructed from a separate piece of lining that is attached to form collar 27. In an alternative exemplary embodiment, the cushioning of collar 27 may be formed by increasing the thickness of the bendable foam or one or more other layers used to form the collar.

Referring to FIG. 3, in embodiments, collar 27 may have a height A in a range of between 1 to 2 inches and may have a thickness B in a range of between 1 to 2 inches. The height and thickness of collar 27 may be selected, at least in part, on the weight of head mask 10. A taller and/or thicker collar may be provided for added comfort and safety when head mask 10 has an increased weight. In an exemplary embodiment, collar 27 has a uniform thickness. However, collar 27 may alternatively have a non-uniform thickness, such as when collar 27 is pre-formed with an increased thickness and does not need to be folded. In the latter case, collar 27 may have a tapered thickness, for example.

Figure 4:
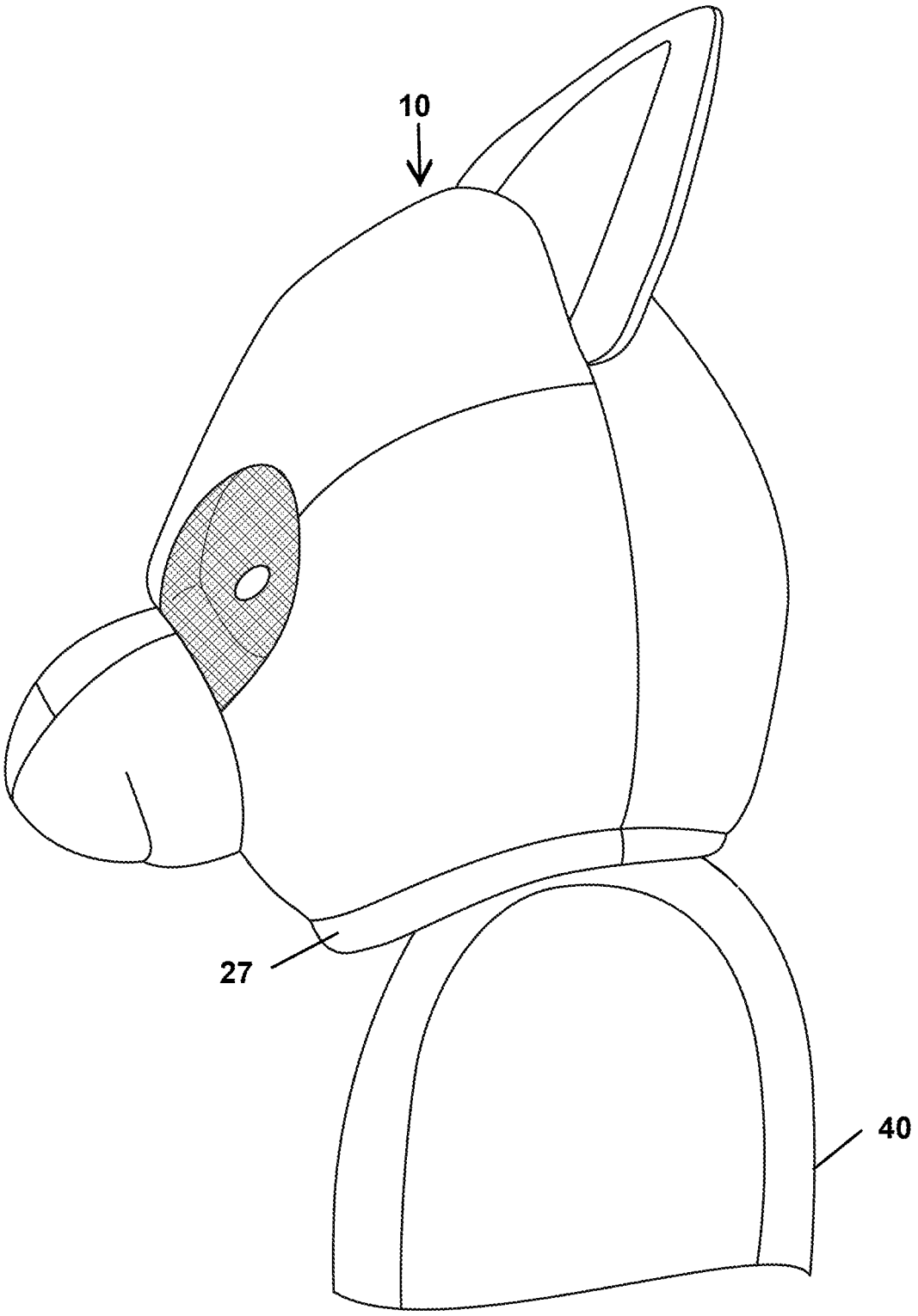
FIG. 4 is a side view of the head mask of FIG. 1 when worn.

FIG. 4 shows head mask 10 in accordance with an exemplary embodiment of the present invention placed over the head over a wearer 40. Wearer 40 places his or her head through aperture 28 and into the interior cavity within shell 30. As will be understood from this figure, by providing a cushioned collar, when the wearer 40 moves his or her head, the cushioning will reduce the impact of collar 27 hitting the wearer's shoulders and/or neck, thereby providing a more comfortable head mask. Depending on the size of the head mask 10, it may or may not rotate relative to the wearer's shoulders when the wearer moves his or her head.

Figure 5:
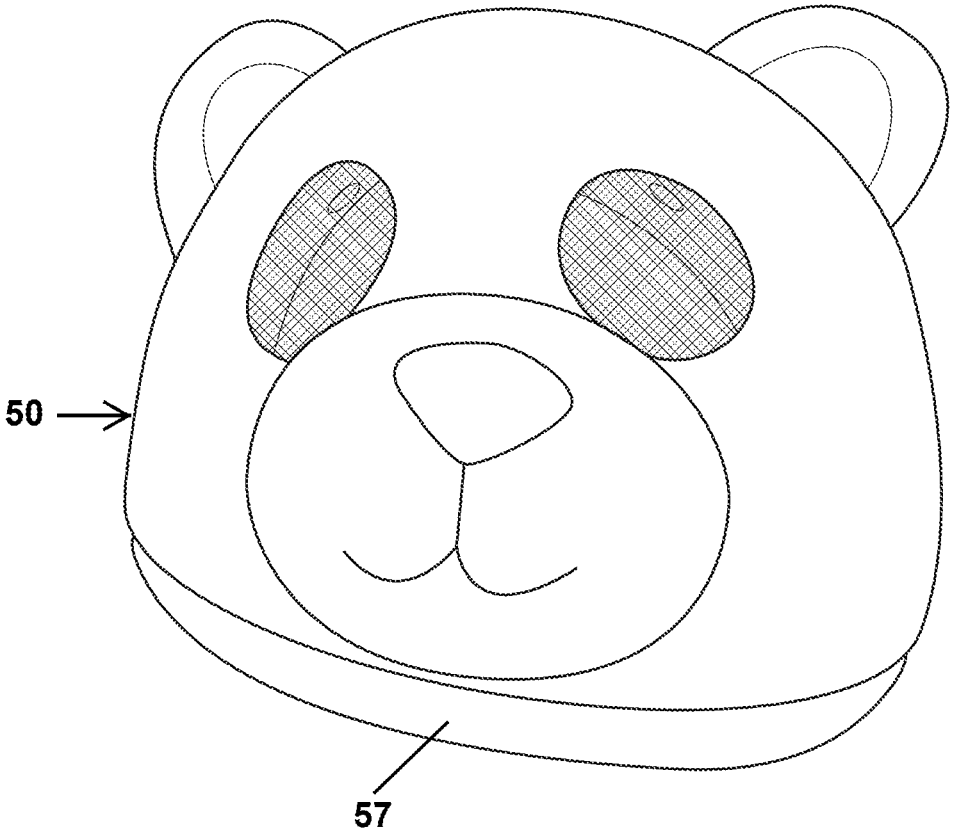
FIG. 5 is a perspective view of a head mask according to a second exemplary embodiment of the present invention.
Figure 6:
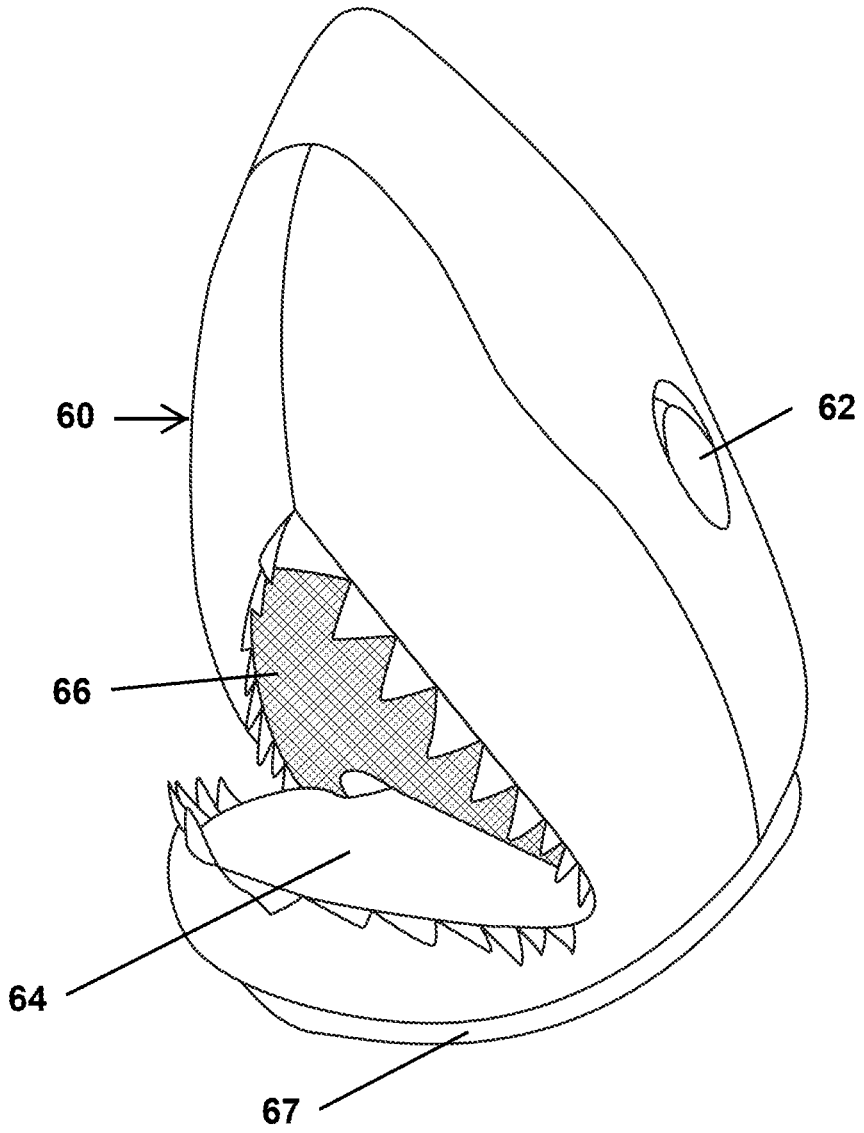
FIG. 6 is a perspective view of a head mask according to a third exemplary embodiment of the present invention.

FIGS. 5 and 6 show two other examples of animal-shaped head masks in accordance with other embodiments of the present invention.

FIG. 5 illustrates a head mask 50 according to a second exemplary embodiment of the present invention where head mask 50 depicts the head of a bear. In this embodiment, the materials used for head mask 50 may, for example, be similar to the materials used for head mask 10 but with different ornamentation and colors. In this second embodiment, head mask 50 may include respective eye openings, ears, nose and a collar 57 that may be constructed similarly to collar 27 with similar dimensions.

FIG. 6 is a perspective view of a head mask 60 according to a third exemplary embodiment of the present invention where head mask 60 depicts the head of a shark. As shown, head mask 60 includes eyes 62 that are decorative in nature, the shark's mouth 64, and collar 67. In the embodiment of FIG. 6, rather than having an opening for a wearer's eyes where the shark's eyes are anatomically, a single opening 66 is provided at the top of the shark's mouth and may be covered with a one-way mesh material. For example, opening 66 may be triangular in shape (e.g., approximately an isosceles triangle) that extends in a range of between 9 to 10 inches in height and in a range of between 6.5 to 7.5 inches in width. Collar 67 may be constructed similarly to collar 27 with similar dimensions.

In alternative embodiments to those described above, a head mask in accordance with the present invention may be shaped and/or decorated on its exterior, for example, as the head of a cartoon character, a celebrity, a team mascot, a scary character, or as some other exterior design.

Now that embodiments of the present invention have been shown and described in detail, various modifications and improvements thereon can become readily apparent to those skilled in the art. Accordingly, the exemplary embodiments of the present invention, as set forth above, are intended to be illustrative, not limiting. The spirit and scope of the present invention is to be construed broadly.

What is claimed is:

1. A head mask, comprising:

(a) a shell having one or more openings configured to enable a wearer to see outside of the head mask when the head mask is worn by the wearer;

(b) an interior cavity within the shell;

(c) an aperture through which a head of the wearer is insertable into the interior cavity;

(d) a collar surrounding at least a first portion of the aperture, wherein the shell has a first thickness, and wherein the collar has a second thickness that is larger than the first thickness;

a fabric layer covering at least the collar of the head mask; and one or more additional layers of materials between the shell and the fabric layer.

2. The head mask of claim 1, wherein the second thickness of the collar of the head mask is attributable, at least in part, to the fabric layer.

3. The head mask of claim 1, wherein the shell comprises a second bendable foam, and wherein a first bendable foam of the collar is integrally formed with the second bendable foam of the shell.

4. The head mask of claim 1, wherein the second thickness of the collar is within a range of 1 to 2 inches.

5. The head mask of claim 1, wherein the collar has a height that is within a range of 1 to 2 inches.

6. The head mask of claim 1, wherein the head mask further comprises one or more pieces of one-way mesh to cover the one or more openings.

7. The head mask of claim 1, wherein the one or more openings are configured to allow for air to enter the interior cavity in addition to enabling the wearer's vision.

8. The head mask of claim 1, wherein the head mask is shaped as an animal head.

9. The head mask of claim 1, wherein the shell comprises a second bendable foam, and wherein a first bendable foam of the collar is attached to the second bendable foam of the shell.

10. A head mask, comprising:

(a) a shell having one or more openings configured to enable a wearer to see outside of the head mask when the head mask is worn by the wearer;

(b) an interior cavity within the shell;

(c) an aperture through which a head of the wearer is insertable into the interior cavity; and (d) a collar surrounding at least a first portion of the aperture, wherein the shell has a first thickness, and wherein the collar has a second thickness that is larger than the first thickness, wherein at least a portion of the collar comprises at least first and second layers formed from a piece of a first bendable foam, wherein at least a part of the second layer of the first bendable foam is folded so as to overlap the first layer of the first bendable foam in a folded position, and wherein the second layer is secured in the folded position.

11. The head mask of claim 10, wherein the second thickness of the collar of the head mask is attributable, at least in part, to the overlapped of the at least first and second layers of the first bendable foam.

12. The head mask of claim 10, further comprising a fabric layer covering at least one side of the first bendable foam of the collar.

13. The head mask of claim 12, wherein the second thickness of the collar portion of the head mask is attributable, at least in part, to the fabric layer.

14. The head mask of claim 10, wherein the shell comprises a second bendable foam, and wherein the first bendable foam of the collar is integrally formed with the second bendable foam of the shell.

15. The head mask of claim 10, wherein the shell comprises a second bendable foam, and wherein the first bendable foam of the collar is attached to the second bendable foam of the shell.

16. The head mask of claim 10, wherein the second thickness of the collar is within a range of 1 to 2 inches.

17. The head mask of claim 10, wherein the collar has a height that is within a range of 1 to 2 inches.

18. The head mask of claim 10, wherein the one or more openings are configured to allow for air to enter the interior cavity in addition to enabling the wearer's vision.

19. The head mask of claim 10, wherein the head mask is shaped as an animal head.

20. A head mask, comprising:

(a) a shell having one or more openings configured to enable a wearer to see outside of the head mask when the head mask is worn by the wearer;

(b) one or more pieces of one-way mesh to cover the one or more openings;

(c) an interior cavity within the shell;

(d) an aperture through which a head of the wearer is insertable into the interior cavity; and (e) a collar surrounding at least a first portion of the aperture, wherein the shell has a first thickness, and wherein the collar has a second thickness that is larger than the first thickness;

wherein at least a portion of the collar comprises at least first and second layers formed from a piece of a bendable foam, wherein at least a part of the second layer of the bendable foam is folded so as to overlap the first layer of bendable foam in a folded position, and wherein the second layer is secured in the folded position.

* * * * *